United States Patent [19]

Syvakari

[11] 4,079,613

[45] Mar. 21, 1978

[54] PRESS WITH EXPANSIBLE PRESSURE CELL AND FORMING PAD

[75] Inventor: Pertti Syvakari, Helsingborg, Sweden

[73] Assignee: Allmanna Svenska Elektriska Aktiebolaget, Vasteras, Sweden

[21] Appl. No.: 688,024

[22] Filed: May 19, 1976

[30] Foreign Application Priority Data

Jun. 24, 1975 Sweden ..... 7507219

[51] Int. Cl.[2] ..... B21D 22/12

[52] U.S. Cl. ..... 72/63

[58] Field of Search ..... 72/63, 56; 100/211

[56] References Cited

U.S. PATENT DOCUMENTS

| | | | |
|---|---|---|---|
| 595,301 | 12/1897 | G rundy | 72/63 |
| 3,376,723 | 4/1968 | Chelminski | 72/56 |
| 3,739,617 | 6/1973 | Stejskol | 72/63 |
| 3,875,778 | 4/1975 | Hellgren | 72/63 X |

*Primary Examiner*—Leon Gilden

*Attorney, Agent, or Firm*—Watson, Cole, Grindle & Watson

[57] ABSTRACT

In a hydraulic press which has an expansible pressure cell arranged in a cavity and a pad of elastic material for forming workpieces, with a trough-shaped supporting member for forming tools and workpieces, displaceable into and out of the press, the press includes a second pressure cell arranged below the trough-shaped supporting member, positioned in a cavity formed between two discs which form supporting members for the trough-shaped supporting member.

8 Claims, 3 Drawing Figures

PRESS WITH EXPANSIBLE PRESSURE CELL AND FORMING PAD

BACKGROUND OF THE INVENTION

1. Field of the Invention

The present invention relates to a press with a very large working surface for forming sheets by means of a pressure cell and a forming pad, influenced by the pressure cell, of elastic material which is pressed against sheets resting on a forming tool. In the press there may be manufactured plates for heat-exchangers, aircraft components such as ribs and the like.

The press according to the invention comprises a press stand with a window opening with a substantially rectangular cross-section. In the press stand a frame or plate is suspended, and in this there is attached a diaphragm which forms a pressure cell. On the underside of the diaphragm there is a thick layer of elastic material forming a pad which forms workpieces. Workpieces are placed on the bottom of a trough-shaped supporting member which is inserted into the working space below the plate with the pressure cell and the pad, whereafter the pressure cell is supplied with pressure medium which causes the pad to be pressed against one or more workpieces on the bottom of the trough-shaped supporting member. In such presses there are great problems with regard to preventing the pressing out of the pad through gaps between the supporting member and surrounding constructional elements in the presses. Particularly great are the problems of preventing pressing out of the pad through the gap between the upper surface of the supporting member and the supporting plate of the pressure cell at the end pieces of the press. Another problem with presses of this kind are deformations in the parts of the press stand, which causes deformation of the trough-shaped member and the forming tools and a reduced accuracy of measurement in the pressed products. In the manufacture of heat-exchanger plates these deformations constitute a serious inconvenience.

2. The Prior Art

In known constructions there is used, for example, an L-shaped strip which is resiliently attached to the part of the supporting plate of the pressure cell which forms an end wall in the space where the pressure cell and the pad are arranged. One flange of the L-shaped strip is attached directly by bolts to the end wall of the supporting plate and the resilience is obtained by bending the flange. By providing recesses in the flange, an increase in the amount of the elastic deflection is obtained. The forces which influence the strip during the pressing are great and sometimes cause the mounting bolts to break even after a short period of use. It has also been difficult to make the resilient parts of the strip flange to stand up against breakage. These bolt and strip ruptures have caused prolonged stoppages in operation. it has also been difficult to avoid the gaps between the ends of different strip parts, through which there is a risk of pressing out of the forming pad.

SUMMARY OF THE INVENTION

According to the invention, the press is designed so that the sealing strips around the forming cavity can be completely eliminated. This is achieved by providing the press with a second pressure cell which lifts up the trough-shaped supporting member for the workpieces so that the surfaces located around the recess are pressed against the surfaces which surround the cavity in which the forming pad and its pressure cell are arranged. In the case of plane surfaces, the gap will be so small that there will be no risk of the forming pad being pressed out. The press is suitably provided with a supporting plate for the through-shaped supporting member which, together with a press yoke or a second plate, forms a substantially closed space. The gap between the constructional elements may, in such a design, be relatively easily bridged by a triangular or L-shaped strip which prevents the diaphragm of the pressure cell from forcing its way out, compared with the gap between the trough-shaped supporting member and the part in which the forming pad with its pressure cell is arranged. The pressure cells influence the trough-shaped supporting member with evenly distributed, substantially equally great forces per surface unit. The supporting member will thus not be subjected to any deforming forces when constructional elements in the press stand are deformed under the influence of the press force.

BRIEF DESCRIPTION OF THE DRAWINGS

The invention will be described in more detail with reference to the accompanying figures.

DESCRIPTION OF THE PREFERRED EMBODIMENTS

Figure 1:
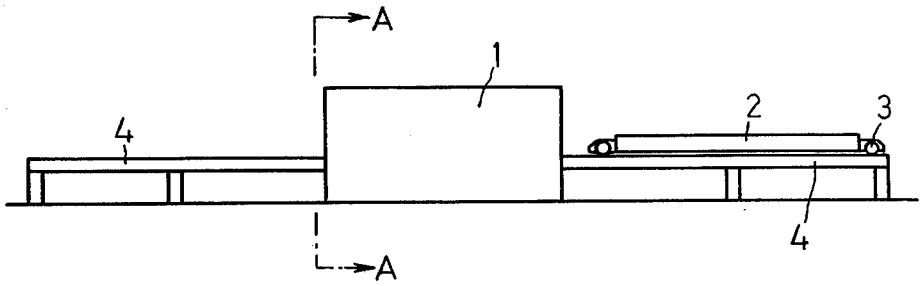
FIG. 1 shows a side view of a press plant, FIG. 2 a section and an end view at A—A and FIG. 3 a vertical longitudinal section at B—B.
Figure 2:
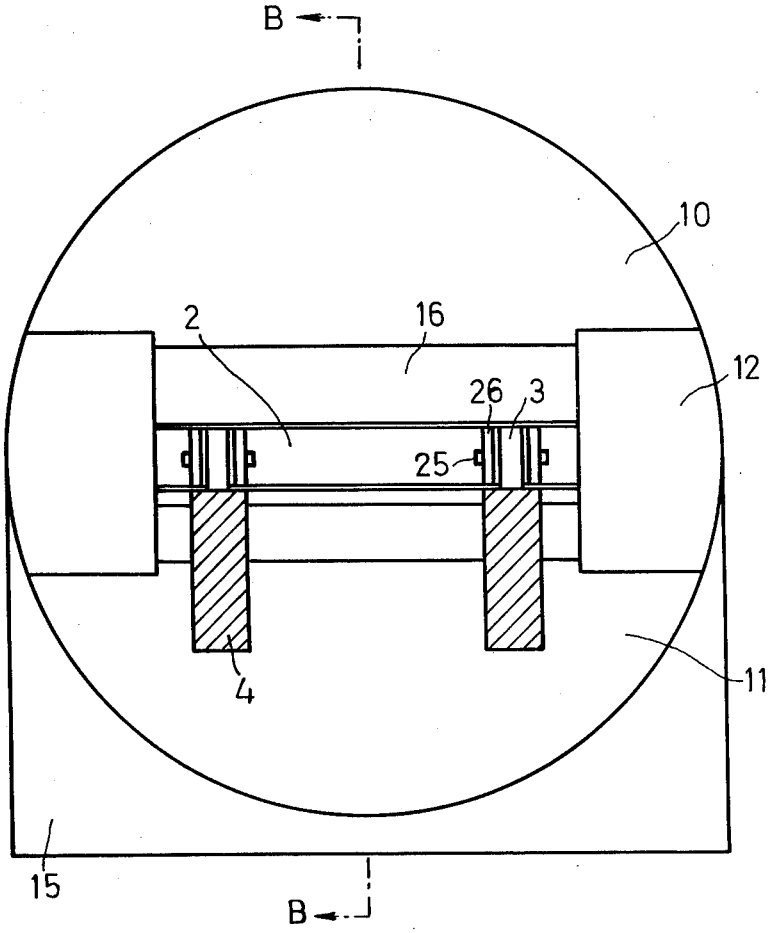
Figure 3:
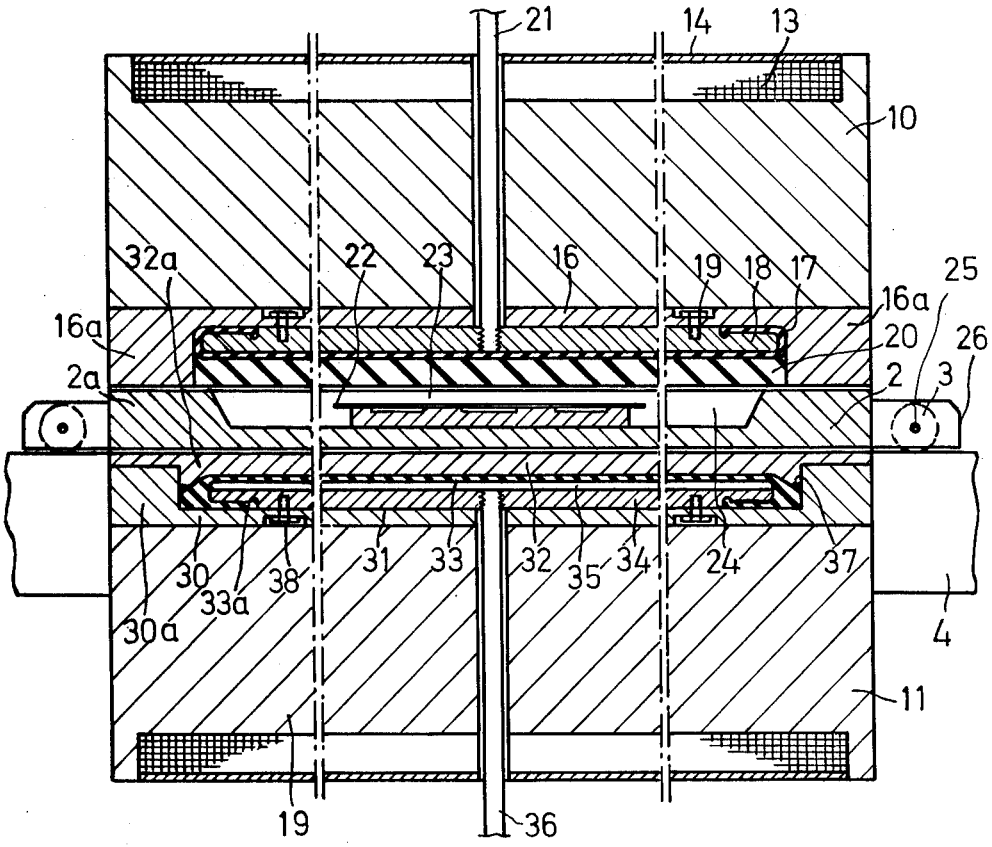

In the figures, 1 designates a press and 2 a trough-shaped supporting member on which workpieces can be placed. The supporting member is provided with driving rollers 3 running on tracks 4. The supporting member is displaceable between the position shown in the figure, where pressed sheets are removed and new sheets are put on forms, and a position within the press where the press pad forms the sheets. The press shown is of the kind having a press stand which is built up from an upper yoke 10, a lower yoke 11 and two intermediate spacers 12 which are held together by a prestressed strip sheath 13. This strip sheath is surrounded by a protective plate 14. The press rests on support 15 with bearing surfaces adjusted to the press. The yokes and spacers form a rectangular window opening in the press. In the space in the press a plate 16 is suspended in the yoke 10 by means of bolts, not shown. In a recess in this plate a diaphragm 17 is attached with the help of the plate 18 and the bolts 19 so that a pressure cell is formed. The space between the diaphragm 17 and the plate 18 communicates with a pressure source (not shown) through conduits 21 by way of valves and conduits (not shown). The diaphragm is joined to a thick pad 20 of elastic material. A sheet 22 on a form 23 in the depression 24 is shaped by filling the pressure cell with a pressure medium so that the pad 20 presses the sheet 22 against the form 23. The driving rollers 3 are journalled on shafts 25 between consoles 26.

in the press there is a disc 30 with a depression 31 which is surrounded by the disc portion **30*a* and a disc 32 with a portion 32*a* fitting the depression 31. In the space which is formed between these discs there is arranged a pressure cell. This is built up from a diaphragm 33 with a flange 33*a* which is clamped against the disc 30 by means of a disc 34 and bolts 38. An annular strip 37 with triangular or L-shaped cross-section prevents the diaphragm 33 from being pressed out between the cooperating parts 30*a* and 32*a*. The space 35 communicates through the tube 36 with a pressure medium source (not shown). By supplying pressure medium to the space 35, the disc 32 can be raised, and thus also the trough-shaped supporting member 2, so that the portion 2***a* around the depression 24 is brought into contact with the portion 16*a* of the plate 16 around the pad 20 and its pressure cell. In this way a completely closed space is formed and the gap is eliminated which in known presses was bridged over by complicated systems of strips, which causes problems particularly at high pressures. The pressure level in presses of the kind referred to here is today 100 MPa and thereabove. The risk that the pad material will be pressed out is great even when very samll gaps exist.

The upward force of the lower pressure cell must exceed the downward force of the upper pressure cell in order for the trough-shaped supporting member 2 to be held pressed against the plate 16 during the forming process. There are two possibilities of achieving this. One possibility is to design the lower pressure cell with a larger surface than the upper cell and connect both cells to the same pressure medium source. The other possibility is to have equally large pressure cells and to connect the lower pressure cell to a pressure medium source with higher pressure than the pressure medium source for the upper pressure cell.

I claim:

1. A diaphragm-type hydraulic press comprising a press stand having a substantially rectangular cross-sectional space therein;

a first pressure cell positioned within said space, said pressure cell comprising a press plate within which are positioned a first diaphragm and an elastomeric pad, said first diaphragm being capable of expanding said first elastomeric pad into said space;

a second pressure cell positioned within said space and oppositely to said first pressure cell, said second pressure cell comprising a lower part and an upper part with a substantially enclosed cavity therebetween, a second diaphragm positioned in said cavity and capable of expanding said upper part into said space;

a trough-shaped supporting member containing a form in said trough, and means for moving said trough-shaped supporting member into and out of said substantially rectangular cross-sectional space with said trough facing said first pressure cell, said second pressure cell operable to lift the trough-shaped member towards said first pressure cell when said trough-shaped member is in said space.

2. The press of claim 1 wherein the dimensions of said upper part of said second pressure cell are at least as large as the dimensions of elastomeric pad of said first pressure cell.

3. The press of claim 1 wherein said lower part of said second pressure cell comprises a U-shaped structure having a base portion and two portions extending perpendicularly away from said base portion; wherein said upper part of said second pressure cell comprises a disk positioned to contact the surfaces of said perpendicularly extending portions of said U-shaped structure to effectively enclose the cavity in said U-shaped structure; and wherein said disk is capable of supporting said trough-shaped supporting member when in said substantially rectangular cross-sectional space.

4. The press of claim 1 wherein means are provided to supply pressure medium to said first diaphragm in said press plate to expand said first diaphragm and said elastomeric pad into said space, and wherein means are provided to supply pressure medium to said second diaphragm positioned in the cavity of said second pressure cell to expand said second diaphragm and said upper part into said space in order to keep said trough-shaped supporting member, when in said space, in abutment against said press plate of said first pressure cell.

5. A hydraulic press comprising a press stand comprising an upper yoke, a lower yoke and two intermediate spacers therebetween, with a substantially rectangular cross-sectional space being formed therebetween;

a first press plate positioned in contact with said upper yoke and in said cross-sectional space having a recess therein opening towards said lower yoke;

a second plate positioned within said recess in said first plate;

a first diaphragm attached to said second plate on a side thereof facing said lower yoke;

a press pad positioned in said recess in said first plate contacting said first diaphragm on the side facing said lower yoke;

means in said second plate which is connected to a conduit which extends through said upper yoke and said first plate for conveying a pressure medium to expand said diaphragm and consequently said press pad away from said second plate towards said lower yoke;

a first disk positioned in contact with said lower yoke in said cross-sectional space having a recess therein opening towards said upper yoke;

a second disk positioned in said recess in said first disk;

a second diaphragm attached to said second disk on a side thereof facing said upper yoke;

a third disk positioned in contact with said second diaphragm and between said second diaphragm and said upper yoke;

means in said second disk which is connected to a conduit which extends through said lower yoke and said first disk to expand said second diaphragm and consequently said third disk away from said second disk towards said upper yoke;

a trough-shaped supporting member which is capable of movement into and out of said rectangular cross-sectional space such that the trough therein faces said upper yoke;

a form positioned within said trough of said trough-shaped supporting member; and support means for said trough-shaped support member allowing said member to be moved into and out of said rectangular cross-sectional space.

6. The press of claim 5 wherein said first disk positioned in contact with said lower yoke is a generally U-shaped structure having a base portion and two portions extending perpendicularly away from said base portion, and wherein said third disk is positioned to contact the surfaces of said perpendicularly extending portions of said U-shaped structure to effectively enclose the recess in said U-shaped structure.

7. The press of claim 6 wherein said third disk is larger in dimensions than the dimensions of the recess in said first press plate.

8. The press of claim 7 wherein said trough of said trough-shaped supporting member is smaller in dimensions than the dimensions of the recess in said first press plate.

* * * * *